United States Patent [19]

Doerner et al.

[11] 3,950,950

[45] Apr. 20, 1976

[54] ROTARY RANKINE ENGINE POWERED ELECTRIC GENERATING APPARATUS

[75] Inventors: William A. Doerner; Oral R. Van Buskirk, both of Wilmington, Del.

[73] Assignee: E. I. Du Pont de Nemours and Company, Wilmington, Del.

[22] Filed: May 5, 1975

[21] Appl. No.: 565,635

[52] U.S. Cl. ..... 60/657; 60/669; 290/2

[51] Int. Cl.[2] ..... F01K 11/04

[58] Field of Search ..... 60/669, 646, 657; 122/11; 290/2

[56] References Cited

UNITED STATES PATENTS

| | | | |
|---|---|---|---|
| 2,576,284 | 11/1951 | Crocchi | 290/2 |
| 2,934,655 | 4/1960 | Heller et al. | 290/2 |
| 3,613,368 | 10/1971 | Doerner | 60/669 X |

*Primary Examiner*—Allen M. Ostrager

[57] ABSTRACT

Rotary closed Rankine cycle engine powered electric generating apparatus including a rotary boiler, power fluid expander and means for condensing the exhaust vapor from the expander. The power fluid expander is rotatably driven at a predetermined speed by pressure fluid generated in the boiler and in turn drives an alternator that is hermetically sealed in a casing rotatable with the boiler and condensing means as a unit. The alternator is rotatably mounted in gas bearings and a portion of the power fluid condensed in said condensing means is utilized to cool the alternator and to provide power fluid vapor at a constant low pressure which is supplied to the gas bearings to lubricate said bearings. In the disclosed embodiments a magnetic-harmonic drive between the alternator and the rotary engine rotatably drives the latter at a predetermined speed substantially slower than the speed of the expander and alternator. In one disclosed embodiment separate primary and secondary condensers are employed for the exhaust vapor condensing means, and in another disclosed embodiment a single condenser is employed.

28 Claims, 12 Drawing Figures

ROTARY RANKINE ENGINE POWERED ELECTRIC GENERATING APPARATUS

This invention relates to new and useful improvements in rotary engine powered electric generating apparatus, and more particularly to closed Rankine cycle engine powered apparatus utilizing gas lubricated bearings for the alternator and having means to supply low pressure gas to the bearings to lubricate said bearings.

Rotary Rankine engines using a high molecular weight power fluid, a single stage turbine expander, and a rotary boiler and condenser are potentially simple, quiet and low in pollution. One method of extracting power from such engines is by the use of an alternator hermetically sealed in the rotary engine casing with the alternator windings attached to the engine casing and the armature driven directly by the turbine, for example, as in U.S. Pat. No. 3,863,454 issued Feb. 4, 1975. While this arrangement eliminates shaft seals and gearing and is quiet and simple with only two moving parts, it does present certain problems. For example, means must be provided for rotatably driving the engine with the boiler and associated condenser and suitable bearings and a bearing lubrication system are required for the high speed turbine/alternator armature shaft which is hermetically sealed inside the engine housing. Also, with rotating condensers that are self-pumping, the means for rotatably driving the engine must supply the necessary air-pumping power to the condenser.

One arrangement for rotatably driving such an engine with the boiler and associated condenser is by mechanical transmission means, such as a fixed-ratio gear train, between the turbine and the engine housing, for example, as shown and described in U.S. Pat. No. 3,769,796 issued Nov. 6, 1973. However, such a transmission requires bearings and a suitable liquid lubrication system must be provided therefor such as, for example, disclosed in U.S. Pat. No. 3,744,246, issued July 10, 1973. Also, in a closed Rankine cycle engine incorporating a liquid lubrication system there is some migration of the engine power fluid into the lubricant.

With the foregoing in mind, a primary object of the present invention is to provide a rotary Rankine cycle engine with internal turbine driven alternator having high speed gas bearings for the turbine and alternator and means for supplying a portion of the engine power fluid vapor at a constant low pressure to said high-speed gas bearings to lubricate the same.

Another important object of the invention is to provide a rotary Rankine cycle engine having an internal turbine driven alternator as described that does not require a mechanical gear drive from the turbine to the engine housing or a liquid lubrication system.

Another object of the invention is to provide a rotary Rankine cycle engine with turbine driven alternator as described wherein a portion of the engine power fluid is supplied to the high speed gas bearings to lubricate same with a constant low pressure vapor that is independent of and intermediate the boiler and turbine exhaust vapor pressures in the engine.

Another object of the invention is to provide a rotary Rankine cycle engine with turbine driven alternator as set forth which is constructed and operable to provide adequate pressure vapor to properly lubricate the gas bearings during start-up of the engine prior to generation of high pressure vapor in the boiler.

Another object of the invention is to provide a rotary Rankine cycle engine with internal driven alternator as set forth comprising a novel magnetic-harmonic drive arrangement between the alternator and the rotary engine housing-boiler-condenser unit to rotatably drive the latter at the designed speed of rotation in a simple, efficient and quiet manner.

Another object of the invention is to provide a rotary Rankine cycle engine with internal turbine driven alternator as set forth having means for cooling the alternator and magnetic-harmonic drive system constructed and arranged to use the heat rejected by the alternator and drive system to provide pressure vapor for lubricating the gas bearings.

Another object of the invention is to provide a rotary Rankine cycle engine with internal turbine driven alternator that is suitable for portable power applications and is of such simplicity that it can be started with a hand crank and a match so that no battery-powered starting system is required.

A further object of the invention is to provide a rotary Rankine cycle engine with internal turbine driven alternator that is devoid of gears, fans, blowers, fuel pumps, drive motors, and other noisy devices and mechanisms that would interfere with the inherent quietness of a closed Rankine cycle turbine engine.

These and other objects of the invention and the features and details of the construction and operation of certain embodiments thereof are hereinafter set forth and described with reference to the accompanying drawings in which:

FIG. 1 is a typical sectional view diametrically through one embodiment of a rotary heat engine powered electric generating apparatus made in accordance with the present invention;

FIG. 1*a* is an enlarged fragmentary view of the internal turbine and alternator driven thereby, shown in FIG. 1;

One embodiment of a rotary closed Rankine cycle engine powered electric generating apparatus embodying the present invention is shown in FIGS. 1 - 10 of the drawings and comprises a rotary housing H containing an annular power fluid boiler B, a power fluid expander PX and an electric current generating alternator A driven by the expander. A condenser C for condensing the expander power fluid is mounted coaxially at one side of the engine housing H for rotation therewith as a unit. In this embodiment of the invention a secondary condenser C′ for the power fluid is coaxially mounted at the opposite side of the engine housing H for rotation therewith, and in another embodiment of the invention shown in FIG. 11 the secondary condenser C′ is eliminated. The power fluid expander PX is driven at a predetermined high speed by the pressure power fluid generated in the boiler B and in turn drives the alternator. The rotary housing-boiler-condenser unit is driven at a predetermined slower speed. The rotary closed Rankine cycle engine is adapted and designed for high molecular weight power fluids.

Figures 1, 7:
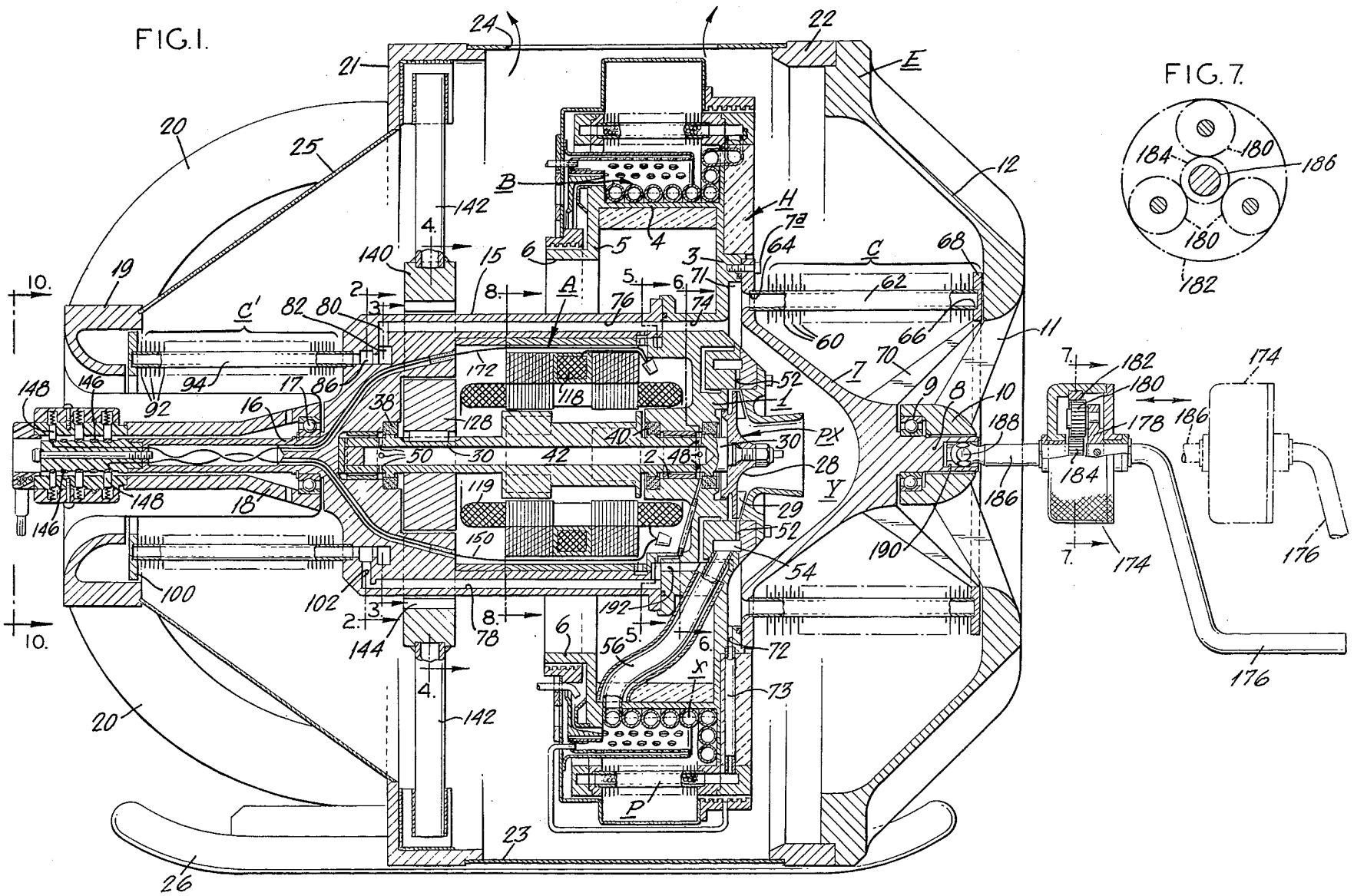
FIG. 7 is an enlarged schematic view on line 7—7 of FIG. 1.

Referring now to the drawings, and particularly to FIG. 1, the rotary engine housing H comprises a coaxial central hub structure 1 provided with a central bore 2 extending axially therein. Extending radially outward from the central hub structure of the housing H is an annular wall portion 3 from which there extends axially a cylindrical wall portion 4 disposed in radially spaced relation to the central hub structure 1 and terminating at the end thereof opposite the wall 3 in a radial wall portion 5 having inwardly thereof an axially extending cylindrical wall portion 6.

The boiler B is of tubular construction mounted on the outer cylindrical surface of the housing wall portion 4. The construction and operation of the tubular boiler B and the circumscribing combustor therefor are described in U.S. Pat. No. 3,850,147 issued Nov. 26, 1974, to which reference may be made and need not be repeated here.

Secured by bolts 7*a* to the radial wall portion 3 of the housing H is an end member 7 of generally conical configuration having at its outer end an axially extending shaft portion 8 that is rotatably journalled by means of a bearing 9 in a coaxial hub 10 that is fixedly supported by a plurality of equally circumferentially spaced struts 11 within an annular generally conical end member 12 of an enclosure E for the engine.

A cylindrical casing 15 for the alternator A is secured, for example, by bolts 13 (FIG. 1*a*) to the central hub structure 1 of the housing H at the opposite side thereof from the conical end member 7. At its outer end the alternator casing 15 terminates in an elongated axially extending tubular shaft portion 16 that is rotatably mounted by means of a bearing 17 in an elongated coaxial sleeve portion 18 of an end ring 19 of the engine enclosure E. The end ring 19 is supported by a plurality of equally circumferentially spaced arcuate struts 20 from an annular ring 21 of the engine enclosure E. Mounted in the outer peripheral portion of the end member 12 of the enclosure E and axially spaced from the ring 21 is an annular ring 22, and the space between the rings 21 and 22 is substantially closed about the rotary engine by a cylindrical closure member 23 having an outlet opening 24 in the upper portion thereof for the exhaust gases from the condensers and the boiler combustor. The space between the end ring 19 and ring 21 of the engine closure E is also closed by a frustoconical member 25 and the bottom portions of the rings 21 and 22 are fixedly secured to a pair of parallel runners 26 that form a skid providing portability for the apparatus.

From the foregoing description it will be apparent that the engine housing H including the central hub structure 1, boiler B and the alternator casing 15 are rotatably mounted by means of the bearings 9 and 17 for rotation as a unit within the stationary engine enclosure E. The rotary housing H, boiler B and alternator housing 15 are adapted to be rotationally driven about their axis at a predetermined speed of rotation calculated to create the centrifugal force necessary to maintain the selected boiler liquid in the axial coil portions of the boiler tubes uniformly at the same depth circumferentially thereabout with a liquid-vapor-interface *x* that is highly stable and essentially cylindrical and concentric with the axis of rotation of the boiler. Essentially the liquid-vapor interface *x* is disposed at a predetermined radius from the rotation axis to provide high boiling heat fluxes in excess of those obtainable at ambient gravity.

The expander PX for the power fluid generated in the boiler B is in the form of a single stage turbine comprising a rotor 28 having a series of turbine blades 29 arranged circumferentially thereabout. The turbine rotor 28 is fixedly secured on one end of a shaft 30 that is mounted for coaxial rotation independently of the rotary housing H and boiler B. Thus the end portion of the shaft 30 adjacent the turbine rotor 28 is rotatably mounted in the bore 2 of the hub structure 1 of the rotary housing H by means of a gas bearing 32 and the opposite end portion of said shaft 30 is rotatably mounted in the outer end wall of the alternator casing 15 by a gas bearing 34. A gas thrust bearing 36 is also provided for the adjacent end of the shaft 30. Vapor at the desired contact pressure is supplied to the gas bearings 32, 34 and 36 as hereinafter described and is maintained at the respective gas bearings by means of seal rings 38 and 40, respectively.

The shaft 30 is drilled to provide a coaxial bore or passage 42 therein, and the otherwise open end of said bore or passage 42 is closed by a plug 44. Pressure vapor is supplied to the gas bearing 32 to lubricate the same through passages 46 in the hub structure 1 of the housing and a portion of the vapor supplied through said passage 46 flows inwardly through a plurality of radial ports 48 in the shaft 30 to the passage 42 therein and then axially through said passage to the other end thereof from which it is discharged through another series of radial ports 50 to lubricate the gas bearings 34 and 36.

For rotatably driving the turbine rotor 28 there is provided in the hub structure 1 of the housing H a plurality of circumferentially equally spaced pressure fluid nozzles 52 that have their outer ends in communication with an annular high pressure manifold 54 and their inner or discharge ends disposed in confronting relation to the blades 29 of the turbine. High pressure vapor generated in the boiler B is supplied to the manifold 54 through a plurality of circumferentially equally spaced vapor tubes 56. Thus the high pressure vapor generated in the boiler B passes inwardly through the vapor tubes 56 to the manifold 54 from which it is discharged inwardly through the turbine nozzles 52 and against the turbine blades to drive the rotor 28 and the shaft 30 at the desired speed of rotation.

An annular diffuser 58 is provided coaxially adjacent the turbine rotor 28 to receive the exhaust vapor from the expander and discharge same into the engine power fluid compartment Y defined by the end member 7 of the rotary housing H. A portion of the exhaust vapor discharged from the turbine through the diffuser 58 into the engine compartment Y enters the condenser C where it is condensed. The condenser C comprises a coaxial array of radially disposed annular fins 60 having a plurality of circumferentially equally spaced heat exchange tubes 62 extending longitudinally therethrough. The condenser C is mounted at one side of the housing H coaxially thereof and secured to the housing for rotation therewith as a unit. The condenser tubes 62 have their inner ends secured in corresponding openings 64 provided in the adjacent peripheral wall portion of the end member 7 of the housing H so that the interiors of the tubes 62 are in communication with the interior of the exhaust vapor chamber Y of the housing. The outer ends of the condenser tubes 62 are mounted and secured in recesses 66 provided in an annular ring 68 that is disposed coaxially adjacent the endmost of the fins 60 and supported from the housing end member 7 by circumferentially equally spaced radial spokes 70. Thus the condenser C, housing H and boiler B are rotatable as a unit about their common axis.

The axial spacing or distance between the adjacent fins 60 and the ratio of the inner to outer radii thereof is critical and the fin spacing is determined with relation to both the rotational speed at which the unit is designed to be driven and the kinematic viscosity of the condenser cooling fluid to have a Taylor number that is operable at the fin radii ratio to utilize the viscous properties of the cooling fluid and the shear forces exerted thereon by the rotating fins 60 to convey and accelerate the cooling fluid spirally outward between said fins by viscosity shear forces in accordance with the invention set forth and described in U.S. Pat. No. 3,866,668 issued Feb. 18, 1975.

The exhaust vapor that enters the heat exchange tubes 62 is condensed by heat exchange with a cooling fluid, such as ambient air, discharged outwardly between the array of fins 60 as previously described. The condensate thus formed in the tubes 62 flows inwardly from the inner ends thereof and collects in an annular chamber 71 provided in the housing H. The condensate that collects in the chamber 71 is conveyed outwardly by centrifugal force generated by rotation of the housing-condenser unit through a plurality of equally circumferentially spaced passages 72 and conduits 73 and returned through a preheater P to the boiler B.

Figure 3:
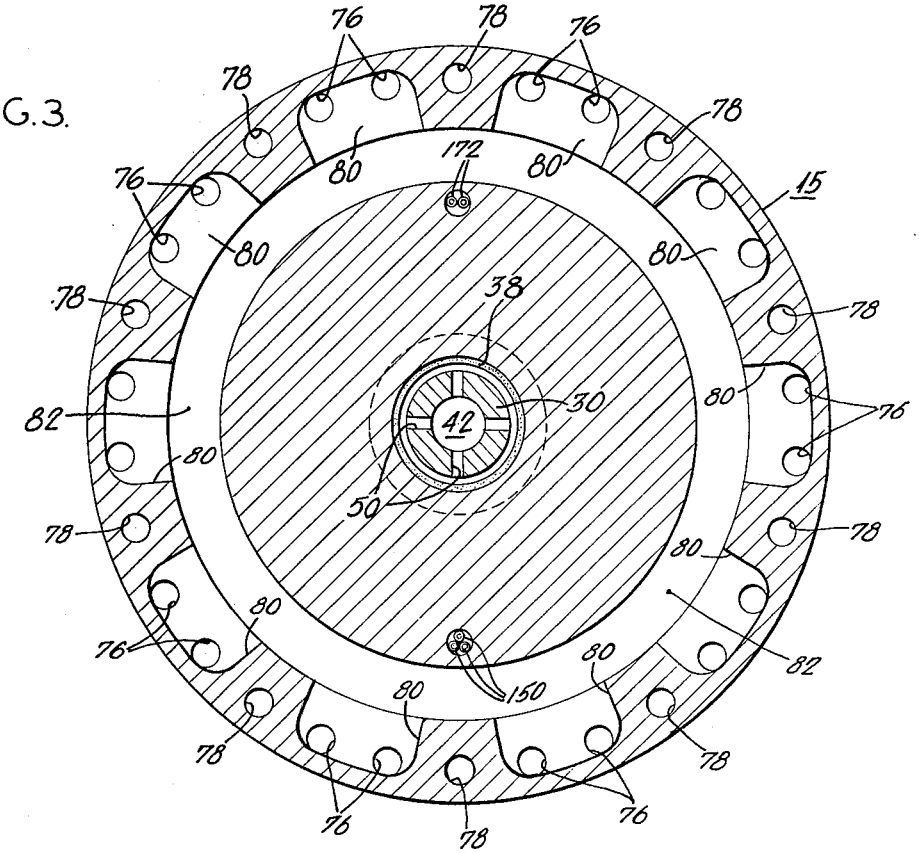
FIG. 3 is an enlarged sectional view on line 3—3 of FIG. 1.

The portion of the turbine exhaust vapor that does not enter the heat exchange tubes 62 of the primary condenser C is caused to flow to the secondary condenser C'. To this end there is provided in the housing central hub structure 1 a plurality of axially extending circumferentially spaced passages 74 which have their outer ends in communication with the exhaust vapor compartment Y of the engine housing and their inner ends disposed in confronting alignment with the inner ends of correspondingly disposed axially extending passages 76 formed in the wall of the cylindrical alternator casing 15. The passages 76 are arranged in pairs and circumferentially disposed alternately with axially extending passages 78 as shown in FIG. 3 of the drawings.

The outer ends of each pair of axial passages 76 communicate through radial passages 80 with a radially inward annular manifold 82 that communicates through an annular passage 84 with an axially adjacent annular manifold 86. The inner radius of the manifolds 82 and 86 and the inter-connecting passage 84 is the same, but it will be observed that the radius of the outer wall of the passage 84 is less than the radius of the outer walls of the manifold 82 and 86 thereby providing a wier or dam 90 between said manifolds disposed at a predetermined radius from the rotation axis of the engine.

As in the case of the primary condenser C, the secondary condenser C' comprises a coaxial array of radially disposed annular fins 92 having a plurality of circumferentially equally spaced heat exchange tubes 94 extending longitudinally therethrough. The secondary condenser tubes 94 have their inner ends secured in corresponding openings 96 provided in the adjacent end wall of the alternator casing 15 and communicate with the manifold 86 through axial passages 98. The outer ends of the secondary condenser tubes 94 are mounted and secured in recesses provided in an annular ring 100. Thus the secondary condenser C' is mounted to rotate with the alternator casing 15 and the housing H, boiler B and condenser C, as a unit.

The purpose of the secondary condenser C' is to supply liquid for cooling the alternator A and to provide vapor at constant pressure for the gas bearings 32, 34 and 36. For proper operation it is necessary that the heat exchange tubes 94 of the secondary condenser C' be disposed radially inward of the axial passages 76 and 78 in the alternator casing 15. The axial spacing or distance between the adjacent fins 92 of the secondary condenser C' is determined with relation to the rotational speed of the housing-boiler-condenser unit and the kinematic viscosity of the secondary condenser cooling fluid to convey and accelerate said cooling fluid spirally outward between the fins 92 by viscosity shear forces as described in connection with the primary condenser C.

By virtue of the construction described, the portion of the turbine exhaust vapor that does not enter the primary condenser C will flow through the passages 74 and 76, then radially inward through the passages 80 to the manifold 82 and thence axially through passages 84 and manifold 86 into the secondary condenser tubes 94 where it is condensed by heat exchange with the cooling fluid, such as ambient air, discharged outwardly between the fins 92 as described.

Vapor condensed in the secondary condenser tubes 94 flows axially inward through said tubes to the annular manifold 86 and thence outwardly through a plurality of radial passages 102 and openings 104 to the axially extending passages 78 in the alternator casing 15 previously described. The openings 104 that communicate between the radial passages 102 and the casing passages 78 are of smaller diameter than the latter to provide therebetween a weir or dam 106 disposed at a predetermined radius from the rotation axis of the engine. Condensate from the secondary condenser C' that enters the passages 78 flows axially inward therethrough and then inwardly through radial passages 108 to an annular manifold 110. The condensate that flows through the passages 78 is vaporized as hereinafter described and the vapor collects in the manifold 110 from which it is supplied to the gas bearings 32, 34 and 36 through a plurality of passages 112, tubes 114 and the previously described passages 46 in the housing hub structure 1.

Figure 1A:
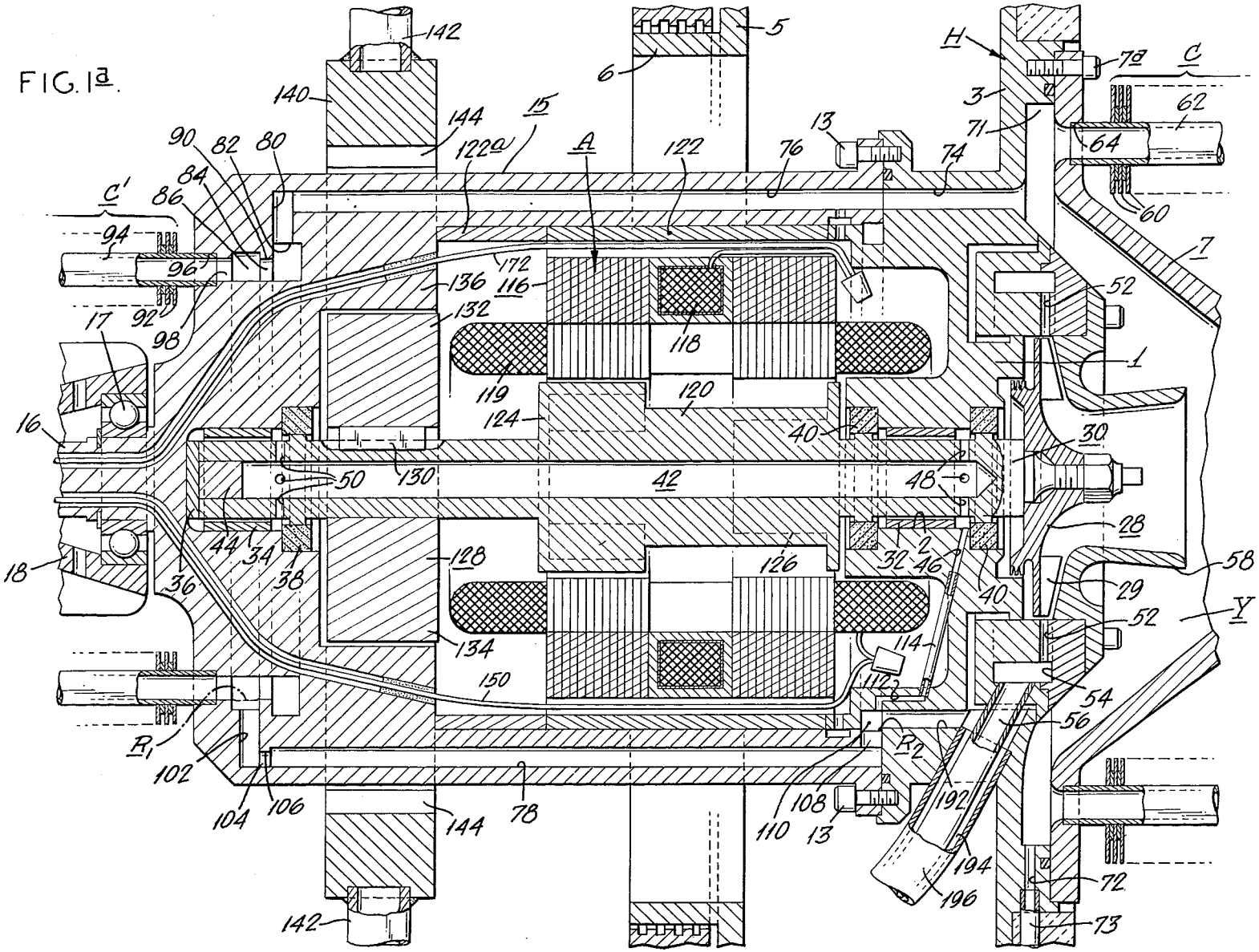
Figure 2:
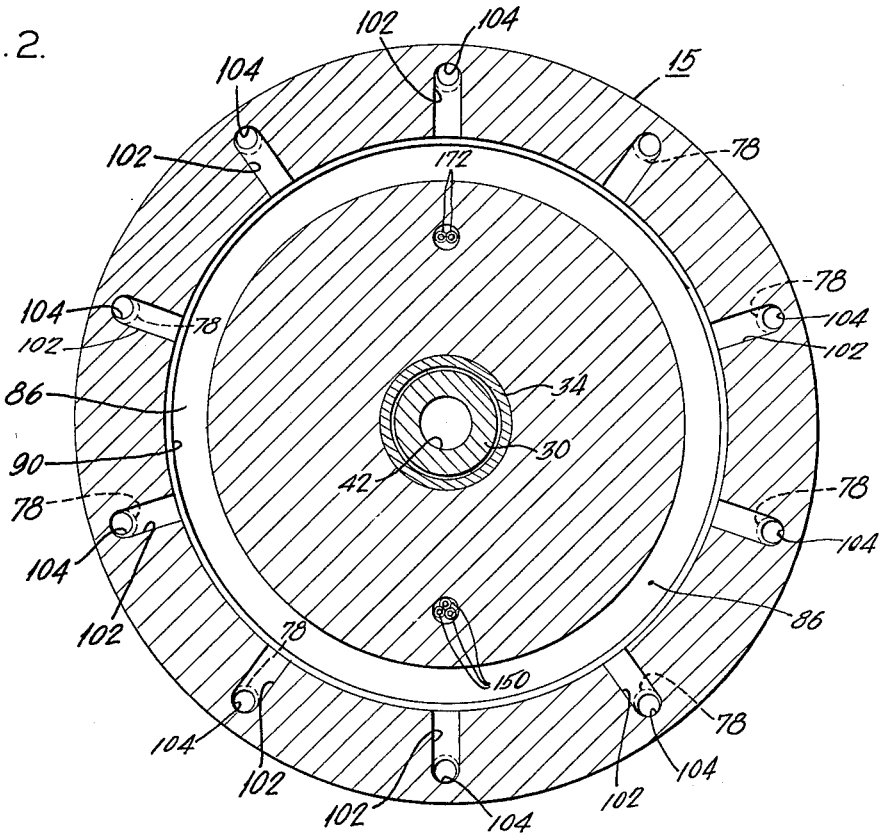
FIG. 2 is an enlarged sectional view on line 2—2 of FIG. 1.

The alternator A is of the known inductor or homopolar type comprising a stator 116 with field and output windings 118 and 119, respectively, and an armature 120. The stator 116 is fixedly mounted within a cylindrical sleeve 122 of magnetic material that is in turn fixedly mounted within the alternator casing 15 so that the said stator 116 and field windings 118 are disposed coaxially of the turbine shaft 30 and rotate with the alternator casing 15 and the engine housing H as a unit. The sleeve 122 is spaced from the outer end wall of the casing 15 by a shorter sleeve **122*a* of non-magnetic material. The alternator armature 120 is integral with the shaft 30 and rotationally driven by the turbine rotor 28. As shown more clearly in FIG. 8, the alternator armature 120 comprises a pair of diametrically disposed electro-magnetic N poles 124 and a pair of diametrically disposed electro-magnetic S poles 126,** the pairs of poles being disposed at right angles to each other and axially spaced apart as shown in FIG. 1*a* of the drawings.

Figure 4:
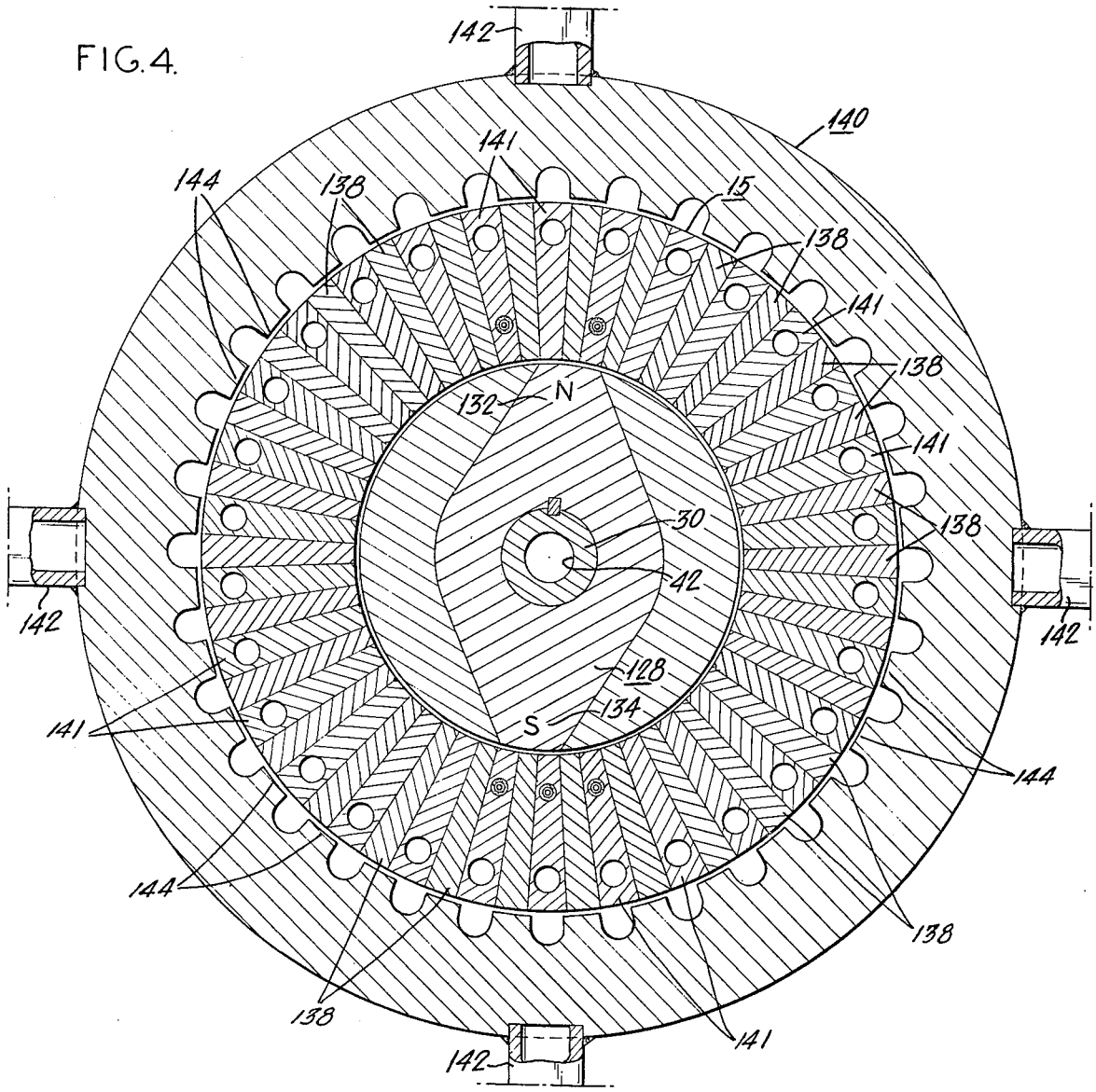
FIG. 4 is an enlarged sectional view on line 4—4 of FIG. 1.
Figure 10:
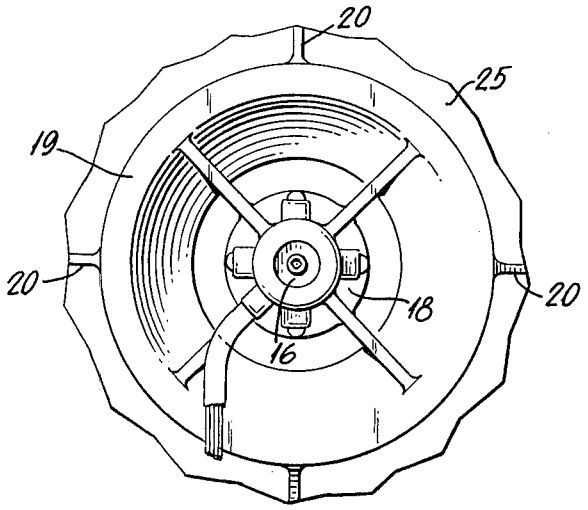
FIG. 10 is a fragmentary end view on line 10—10 of FIG. 1.
Figure 5:
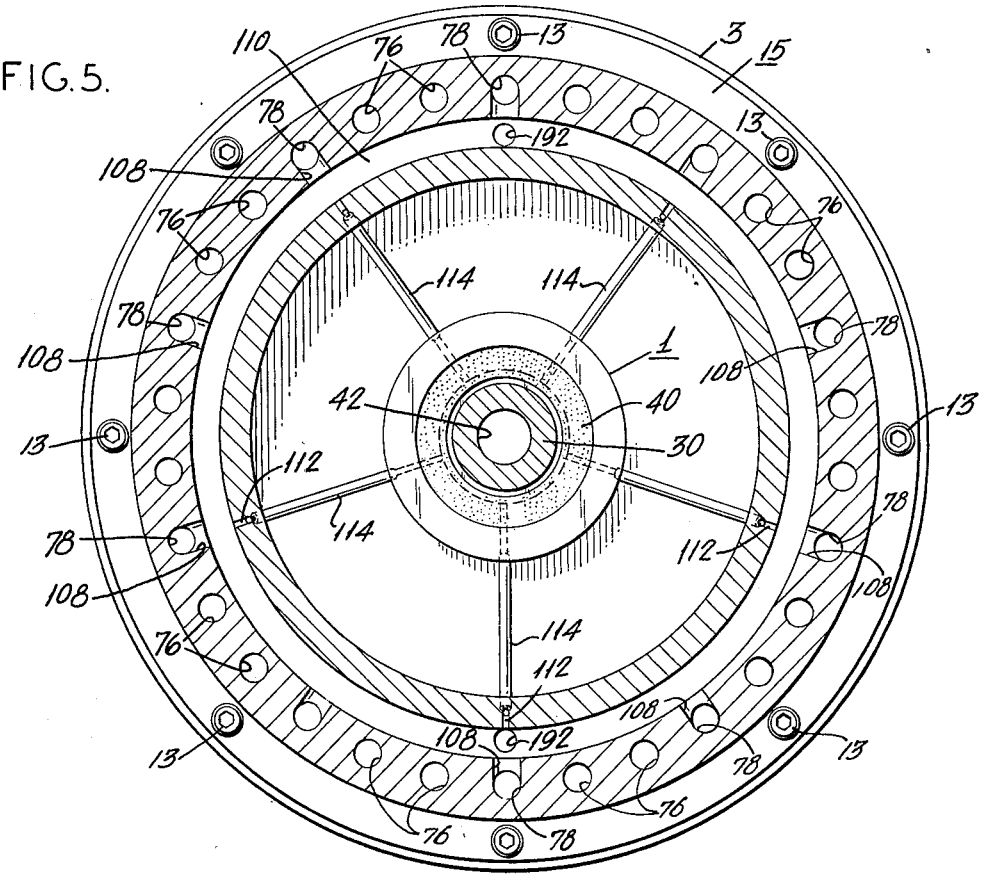
FIG. 5 is an enlarged sectional view on line 5—5 of FIG. 1.
Figure 6:
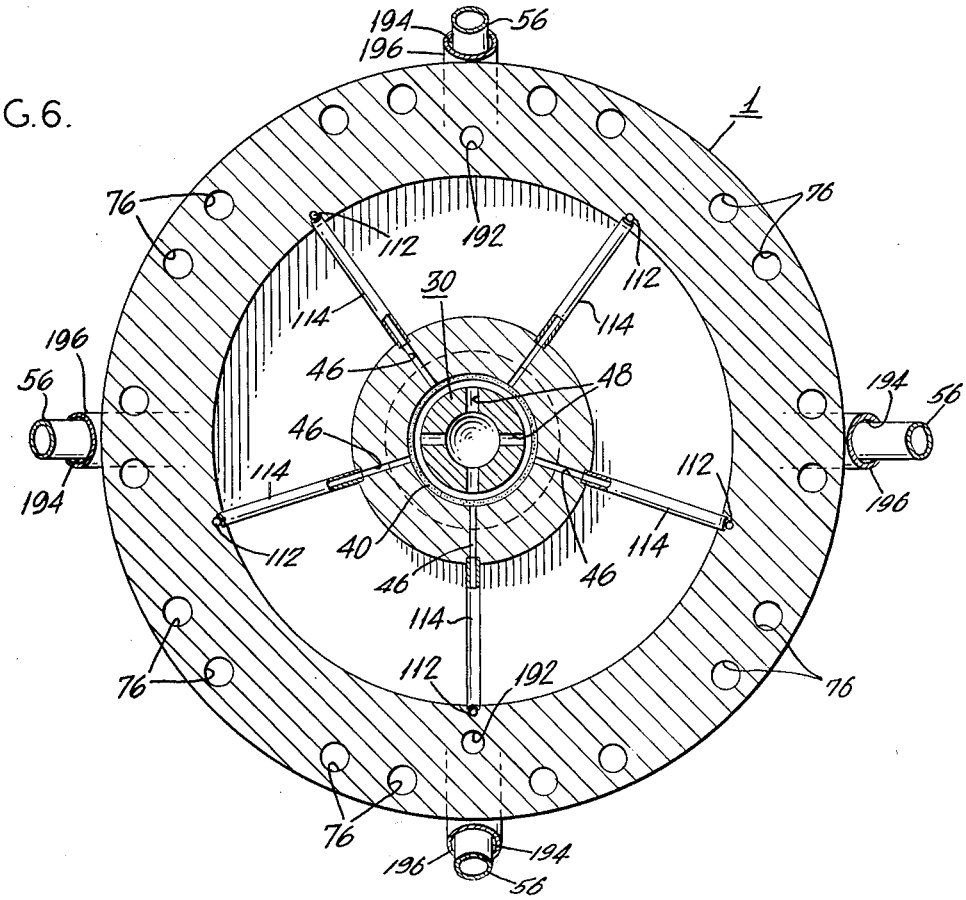
FIG. 6 is an enlarged sectional view on line 6—6 of FIG. 1.
Figure 8:
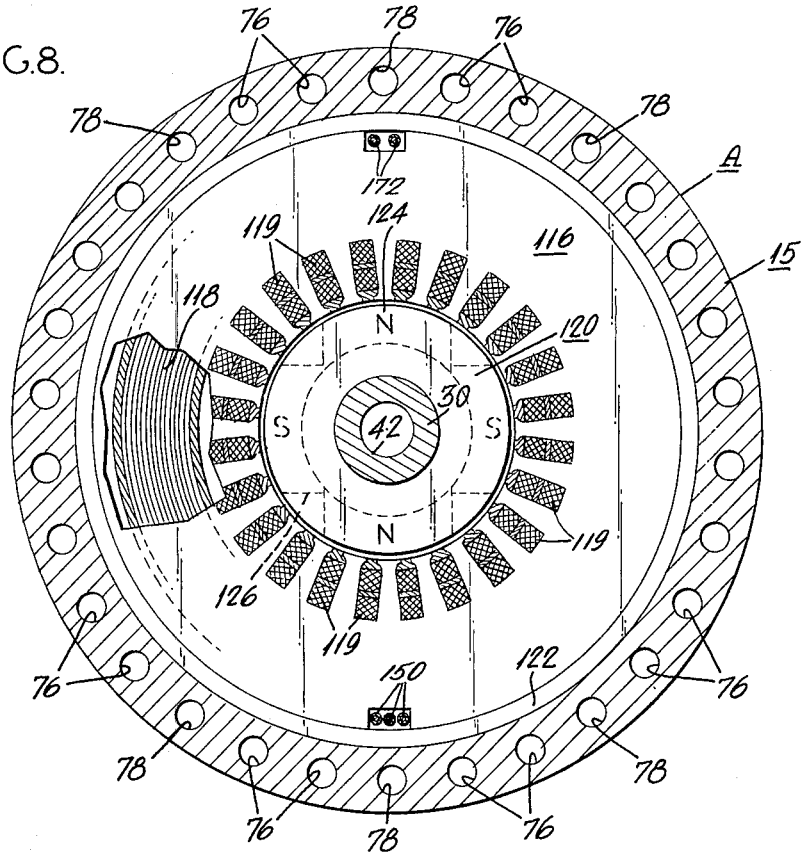
FIG. 8 is an enlarged sectional view on line 8—8 of FIG. 1.

As previously stated, the rotary engine housing H, boiler B and condensers C and C′ are rotatably driven as a unit at a comparatively slow speed relative to the high speed of the turbine and shaft 30. In the disclosed embodiment of the invention the housing-boiler-condenser-unit is driven by the high speed turbine shaft 30 through a magnetic-harmonic drive, although other drive means such as, for example, an external electric motor may be employed as desired. In the embodiment shown, the magnetic-harmonic drive comprises a two pole permanent magnet rotor 128 that is fixedly secured, as by a key 130, on the turbine shaft 30 for rotation therewith. As shown in FIG. 4, the two pole permanent magnet rotor 128 has diametrically disposed N and S poles 132 and 134, respectively. Mounted in the portion 136 of the alternator casing 15 that circumscribes the two pole permanent magnet rotor 128 is an annular series of a plurality of circumferentially equally spaced radially extending magnetic segments 138 that circumferentially surround the rotor 128 and are alternately disposed with intervening portions 140 of the non-magnetic alternator casing 15.

Closely surrounding the non-magnetic alternator casing 15 in radial alignment with the two pole permanent magnet rotor 128 and the circumferential series of magnetic segments 138 is a stationary annular ring member 141 that is fixedly supported from the ring 21 of the engine enclosure E by means of a plurality of circumferentially equally spaced radial spokes 142. The ring member 141 is fabricated of magnetic material and the inner circumference thereof is constructed to provide a plurality of circumferentially equally spaced pole tips 144. The magnetic segments 138 in the portion 140 of the alternator casing 15 tend to align with the pole tips 144 of the stationary ring member 140 to minimize the reluctance of the magnetic flux path of the two pole permanent magnet rotor 128. However, there are fewer magnetic segments 138 than there are pole tips 144 in the stationary ring 140, so that as the permanent magnet rotor 128 and shaft 30 are driven by the turbine at high speed, the segments 138 and casing 15 together with the engine housing H, boiler B, and condensers C and C′ are caused to rotate in the opposite direction relative to the two pole permanent magnet rotor 128 and turbine shaft 30 at a substantially slower speed.

The ratio of speed reduction from the rotor 128 and shaft 30 to the alternator casing 15 and engine housing H is determined by the number of pole tips 144 provided in the stationary ring member 140 and the difference between the number of said pole tips 144 and the number of magnetic segments 138 in the portion 136 of the alternator casing 15. Such a magnetic-harmonic drive is a simple and efficient arrangement for providing the necessary high ratio of speed reduction between the turbine and engine housing while simultaneously providing the necessary torque to rotate the engine housing H and condensers C and C′ at the required speed. Since there are no contacting parts in the magnetic-harmonic drive, there is no noise or wear and no lubrication is required as would be the case with a gear transmission.

The alternator A generates alternating current which is conducted from the engine housing H through a conventional slip-ring arrangement comprising a plurality of rotating contacts 146 mounted on the outer end of the elongated shaft portion 16 of the alternator casing 15 and having electrical contact with the corresponding number of circumscribing brushes 148 mounted in the sleeve 18 of the stationary ring 19 of the engine enclosure E. A typical alternator electrical circuit is illustrated schematically in FIG. 9 of the drawings.

Figure 9:
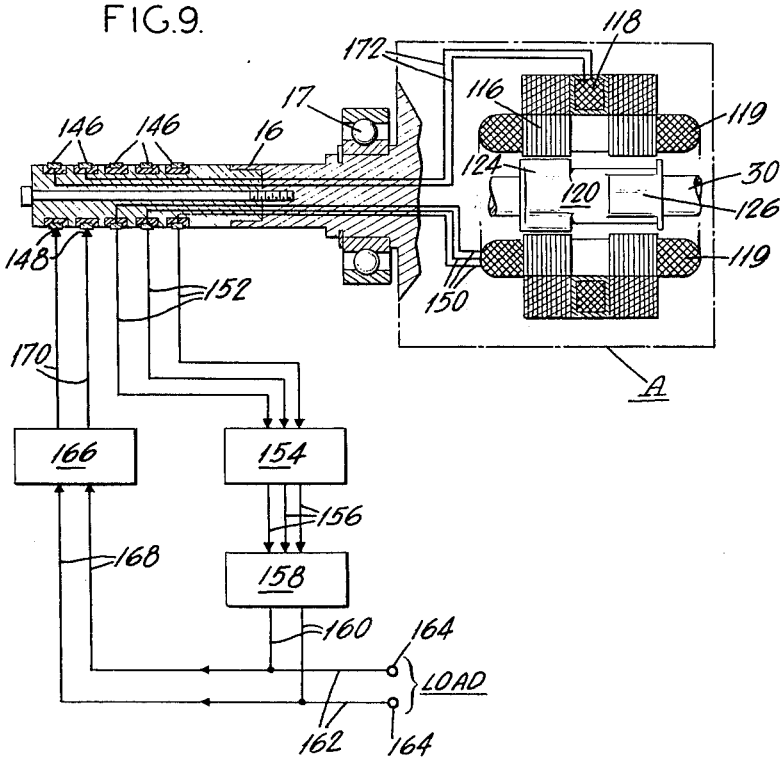
FIG. 9 is a schematic diagram of an alternator circuit for the embodiment of the invention shown in FIG. 1.

Referring to FIG. 9 of the drawings, three phase alternating current generated by the alternator A is conducted from the alternator stator output windings 119 through conductors 150 to three of the rotating contacts 146 and thence through the corresponding brushes 148 and conductors 152 to a transformer 154. Conductors 156 conduct the current from the transformer 154 to a rectifier 158 which converts the alternating current generated by the alternator A to direct current. The direct current from the rectifier 158 is conducted by a pair of conductors 160 to the line conductors 162 of a service circuit that includes the main load terminals 164. The input terminals of a voltage regulator 166 are connected by a pair of conductors 168 to the aforesaid conductors 160 and the output terminals of the regulator 166 are connected by conductors 170 to the remaining brushes 148 whereby current for the field windings 118 for armature magnetization is supplied through the corresponding rotary contacts 146 and conductors 172.

In operation of the engine, it will be apparent at start-up that there will be no pressure vapor generated by the boiler B to drive the expander PX, alternator A, housing H and the condensers C and C′. Consequently at start-up it is necessary to independently drive the housing-boiler-condenser unit up to the designed predetermined speed of rotation to establish and maintain the liquid-vapor interface *x* in the boiler chamber until the annular body of the power liquid therein is heated to the temperature required to produce the pressure vapor to drive the turbine rotor 28 and shaft 30 at the designed speed. This may be accomplished, for example, by means of a detachable hand crank device of the type shown in FIG. 1 of the drawings.

The hand crank device comprises a gear casing 174 which is held by the operator in one hand while he rotates the crank 176 by the other hand. The crank 176 rotatably drives a planetary gear carrier 178 that drives a plurality of planetary gears 180 around a ring gear 182 thereby causing the sun gear 184 to drive the output shaft 186 at a high speed sufficient to bring the rotary engine up to its designed starting speed. The output shaft 186 of the hand crank device may be temporarily engaged with the engine housing shaft portion 8 for starting purposes by means of a rounded hexagonal end portion 188 on said shaft 186 that is engageable in a corresponding hexagonal socket 190 provided coaxially in the end of the housing shaft portion.

Once the rotary engine is brought up to the designed starting speed, fuel and air in the proper ratio are supplied to the boiler combustor and ignited in any suitable manner. After start-up, operation of the engine may be automatically controlled by means well known in the art constructed and operable to control the supply of fuel and air to the combustor at the rate to maintain the engine and turbine speed constant and to control the excitation voltage supplied to the armature field windings 118 to maintain the alternator output voltage constant.

In normal operation of the rotary engine shown in FIGS. 1–10 of the drawings, with the annular body of liquid in the boiler B heated to the required temperature and pressure by combustion of the fuel-air mixture in the combustor, the high pressure vapor generated in the boiler is discharged inwardly through the tubes 56 to the manifold 54 and thence through the nozzles 52 into impinging contact with the turbine blades 29 thereby driving the turbine rotor 28, shaft 30, alternator armature 120 and the two pole permanent magnet rotor 128 at the designed predetermined speed of rotation. Rotation of the two pole permanent magnet rotor 128 operates through the magnetic-harmonic drive previously described to drive the alternator casing 15, engine housing H and the condensers C and C′ in the opposite direction at a predetermined substantially slower speed of rotation relative to the shaft 30 determined by the speed reduction ratio of the magnetic-harmonic drive arrangement as previously set forth.

The exhaust vapor from the turbine discharges through the diffuser 58 into the compartment Y of the engine housing H from which it flows to and enters the primary condenser C and secondary condenser C′ as previously described. Apportionment of the exhaust vapor between the primary condenser C and secondary condenser C′ is determined by the relative capacities of the condensers C and C′ and by the flow restriction of the axial passages 74 and 76 in the housing hub structure 1 and alternator casing 15, respectively, through which exhaust vapor is supplied to the secondary condenser C′.

The function of the secondary condenser C′ is to supply liquid for cooling the alternator A and the magnetic-harmonic drive to the rotary engine and to provide vapor at constant pressure to the gas bearings 32, 34 and 36. The alternator A and magnetic-harmonic drive are cooled by liquid condensate from the secondary condenser C′ flowing through the axial passages 78 in the alternator casing 15 as previously described. Pressure vapor for the gas bearings is generated by vaporizing the liquid condensate in the passages 78 which is heated to a boiling temperature by heat from the alternator field windings 119 and from the eddy current losses in the magnetic-harmonic drive.

Liguid condensate from the secondary C′ normally is maintained in the annular manifold 86 at the level designated $R_1$ determined by the radius of the weir 90 and the liquid condensate normally fills the axial passages 78 in the alternator casing 15 to the level designated $R_2$. The vapor generated by heating the condensate in the casing passages 78 as described, collects in the manifold 110 and is supplied to the gas bearings 32, 34 and 36 at a constant pressure which is the sum of the pressure in the secondary condenser C′ and the pressure developed by the difference between the condensate liquid levels at $R_1$ and $R_2$, respectively, under the influence of the centrifugal forces present at said liquid levels. The weir 106 normally prevents vaporized condensate from returning to the secondary condenser C′ and insures that the vapor flows to the aforesaid manifold 110 and thence to the gas bearings 32, 34 and 36.

In operation, the vapor supplied to the gas bearings is slowly dissipated through the seal rings 38 and 40, respectively. If the condensate in the alternator casing passages 78 is heated by the alternator cooling load at a rate that produces vapor faster than required by the gas bearings 32, 34 and 36, excess vapor will flow back through the passages 78 and over the weir 106 to the secondary condenser C′ and condensed again. On the other hand, if vapor is produced by the alternator cooling load at a rate insufficient to provide the vapor pressure required for the gas bearings, the pressure at the gas bearings will drop thereby permitting the condensate liquid level $R_2$ to move radially inward. When this occurs, liquid condensate will overflow through a plurality of axial passages 192 in the hub structure 1 and into elongated annular vaporizing chambers 194 formed circumferentially about each of the high pressure boiler tubes 56 by tubular jackets 196 disposed in concentric relation about the boiler tubes 56. Thus, liquid overflowing into and through the axial passages 192 into the vaporizing chambers 194 is exposed to the high temperature of the walls of the vapor tubes 56 and will be immediately vaporized thereby to provide the necessary vapor pressure to the gas bearings for proper operation and restore the normal liquid level $R_2$ in the manifold 110. In the event that excess condensate collects in the manifold 86 thereby causing the liquid level $R_1$ to move radially inward, the excess condensate will flow over the weir 90 to the manifold 82 and through passages 80, 76 and 74 back to the exhaust vapor compartment Y of the engine where it collects in the annular chamber 71 and is returned to the boiler B through the passages 72, tubes 73 and pre-heater P along with the condensate from the main condenser C.

During start-up as previously described, it is important to provide the required vapor pressure to the gas bearings to minimize wear. First, the housing-boiler-condenser unit and the alternator armature-turbine unit are brought up to starting speed by the hand crank device previously described. With no supply of pressure vapor, the gas bearing friction will tend to minimize the difference in speed between the housing-boiler-condenser unit and the alternator-turbine unit. When the engine has been brought to starting speed the combustor is ignited. Since at start-up, there will be low pressure in the gas bearings, the liquid level $R_2$ will move radially inward causing liquid to overflow through the passages 192 into the annular vaporizing chambers 194 surrounding the boiler vapor feed tubes 56. Liquid entering the chambers is heated sufficiently by the boiler vapor tubes to vaporize the liquid and supply adequate vapor to the gas bearings long before the boiler B is generating sufficient vapor pressure to drive the turbine 28 at the desired speed of rotation. The reverse situation occurs at shutdown and maintains adequate pressure in the gas bearings until rotation of the turbine 28 and shaft 30 has terminated.

A typical example of closed Rankine cycle rotary engine powered apparatus embodying the construction shown in FIGS. 1–10 and designed for an output of 7.1 hp at the turbine shaft 30, comprises a boiler B having a liquid level *x* diameter of 7.0 inches and an axial length of 2.5 inches. The diameter of the boiler expander turbine at the blades 29 is of the order of 3.6 inches. The fins 60 of the primary condenser C have an outer diameter of 9.5 inches and an inner diameter of 6.75 inches. The axial length of the series of condenser fins 60 is 8.5 inches and the spacing between adjacent fins is 0.025 inches. There are 40 heat exchange tubes 62 disposed at a radius of 8.125 inches from the rotation axis of the apparatus.

The fins 92 of the secondary condenser C′ have an outer diameter of 6.0 inches and an inner diameter of 4.25 inches. The axial length of the series of fins 92 is 5.0 inches and the spacing between adjacent fins is 0.023 inches. There are 32 axially extending heat exchange tubes 94 disposed at a radius of 5.125 inches from the rotational axis of the apparatus. The designed speed of the turbine shaft 30 is 48,000 r.p.m. and the housing-boiler-condenser assembly is rotationally driven at a speed of 3000 r.p.m. by the turbine through the magnetic-harmonic drive as previously described.

Using as the boiler power fluid a mixture of trichlorodifluorobenzene isomers, as disclosed in U.S. Pat. No. 3,774,393 issued Mar. 27, 1973, the specifications of a typical operation of the designed apparatus are as follows:

| | |
|---|---|
| Boiler temperature, °F | 620.0 |
| Boiler pressure, psia | 149.0 |
| Boiler heat load, $10^3$ Btu/hr | 104.4 |
| Power fluid flow rate, lb/sec | 0.172 |
| Condenser temperature, °F | 243.0 |
| Condenser pressure, psia | 1.0 |
| Combined condenser heat load, $10^3$ Btu/hr | 90.0 |
| Rankine cycle efficiency | 0.246 |
| Alternator power output, kw | 3.6 |
| Magnetic-harmonic drive torque, ft-lbs | 1.6 |

While in most installations of apparatus embodying the present invention it will be preferred to provide both a primary and a secondary condenser C and C′ as previously described, in some instances it may be possible to eliminate the secondary condenser and combine the functions of both primary and secondary condensers in a single condenser. One embodiment of such an apparatus having a single condenser is shown in FIG. 11 of the drawings.

Figure 11:
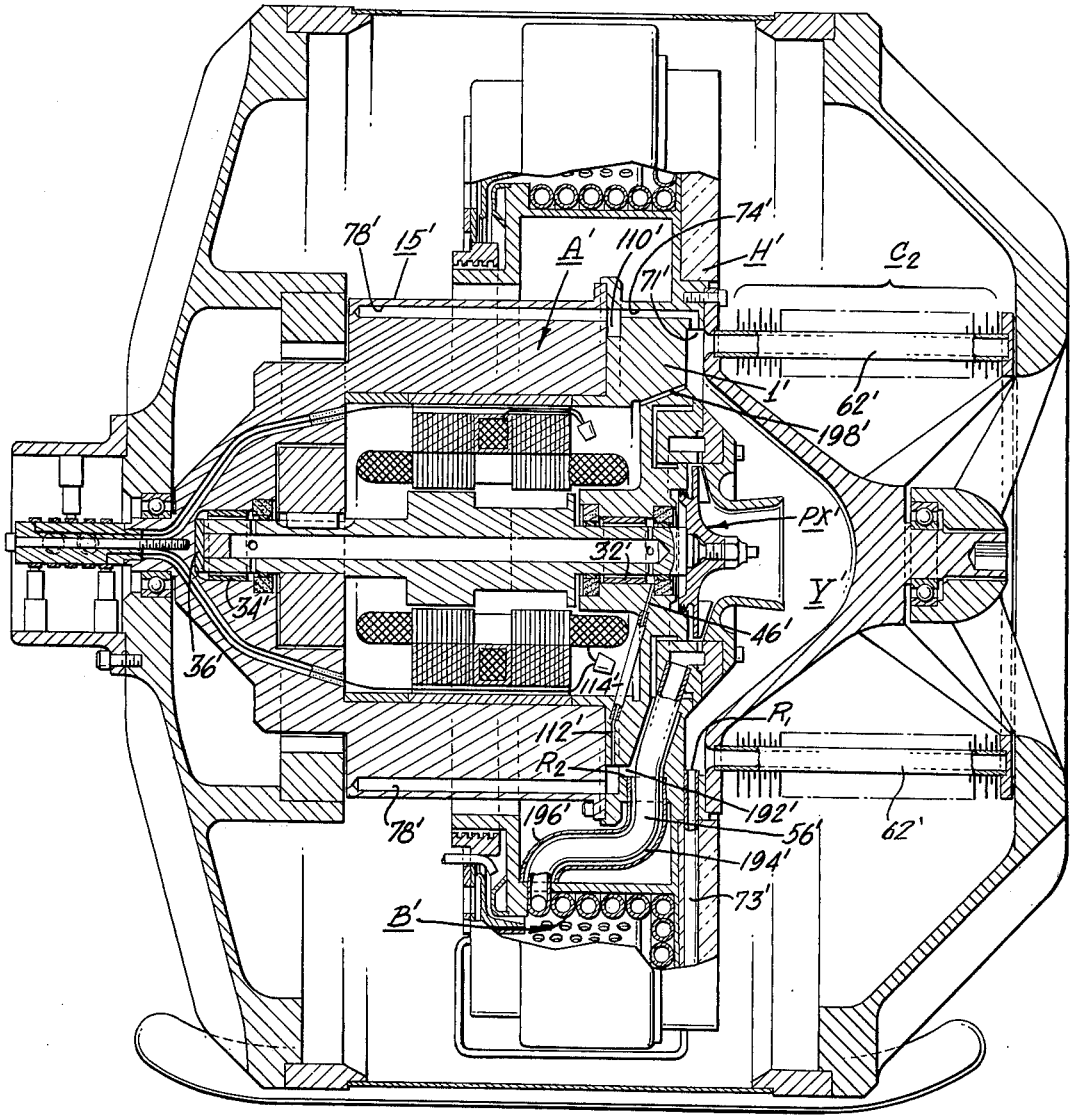
FIG. 11 is a view similar to FIG. 1 showing an alternate embodiment of the invention.

Referring to FIG. 11, except for certain differences hereinafter set forth, the construction and operation of the rotary housing H′, boiler B′, expander PX′, condenser $C_2$, alternator A′ and magnetic-harmonic drive, are essentially the same as the corresponding parts described in the embodiment shown in FIGS. 1–10, and need not be repeated. The principal difference in the embodiment of FIG. 11 from that previously described is that the alternator A′ is cooled and pressure vapor supplied for the gas bearings 32′, 34′ and 36′, by a portion of the exhaust power fluid discharged from the expander PX′ to the engine compartment Y′ and condensed in the single condenser $C_2$.

Condensate from the heat exchange tubes 62′ collects in an annular chamber 71′ provided in the engine housing H′ and the major portion of the condensate is returned directly to the boiler B′ through conduits 73′ as previously described. The remaining portion of the condensate collecting in the chamber 71′ is utilized to cool the alternator A′ and supply pressure vapor for the gas bearings as previously stated.

This is accomplished by providing in the alternator casing 15′ a plurality of equally circumferentially spaced axially extending passages 78′ that are closed at their outer ends and have their inner ends open to an annular manifold 110′ to which liquid condensate is supplied from the chamber 71′ through two or more circumferentially equally spaced passages 74′ formed in the housing hub structure 1′. The axially extending passages 78′ in the casing 15′ are disposed at a greater radius from the engine rotating axis than the condenser tubes 62′.

The alternator A′ and magnetic-harmonic drive are cooled by the liquid condensate in the passages 78′ in the alternator casing 15′ and pressure vapor for the gas bearings is generated by vaporizing the liquid condensate in said passages 78′ which is heated to boiling temperature by heat from the alternator windings and from the eddy current losses in the magnetic-harmonic drive. Vapor produced in passageways 78′ collects in manifold 110′ and flows through passages 112′, tubes 114′ and passages 46′ to the gas bearings as previously described. The pressure of the vapor delivered to the gas bearings is the sum of the pressure in condenser $C_2$ and the pressure developed by the difference of the condensate liquid legs at $R_1$ and $R_2$, respectively, under the influence of the centrifugal forces present at $R_1$ and $R_2$.

If insufficient vapor is produced in passageways 78′, the pressure around the gas bearings will drop thereby permitting the liquid level at $R_2$ to move radially inward. Liquid will then flow through passages 192′ to the annular vaporizing chambers 194′ between the boiler feed tubes 56′ and the boiler feed tube jackets 196′. Liquid exposed to the high temperature walls of boiler feed tubes 56′ will be immediately vaporized to provide the necessary vapor pressure for the gas bearings and return the liquid to its original level $R_2$. If the heat from the alternator A′ and the magnetic-harmonic drive system produce more vapor in passageways 78′ than can be used by the gas bearings, the liquid level at $R_2$ will move radially outward until the excess vapor escapes back through manifold 110′ and passages 74′ to the condenser $C_2$. The manifold 110′ and passages 78′ are constructed to provide a capacity for as much liquid as is required to supply the necessary vapor to the gas bearings 32′, 34′ and 36′ with the balance of the condensate from condenser being returned directly to the boiler B′ as described. Any vapor or liquid that collects in the alternator casing is vented through passageways 198′ to the engine compartment Y′.

From the foregoing it will be observed that the present invention provides novel rotary closed Rankine cycle engine turbine powered electric generating apparatus comprising a turbine driven alternator that embodies high speed gas bearings for the turbine and alternator and means for supplying a portion of the engine power fluid vapor at a constant low pressure to lubricate the high speed gas bearings. The apparatus does not require a mechanical drive from the turbine to the rotary engine or a liquid lubrication system. The gas bearings and lubrication thereof together with the magnetic-harmonic drive from the turbine shaft to the rotary engine provide a simple and efficient apparatus that is devoid of gear, fans, blowers, pumps, drive motors and other noisy mechanisms that would interfere with the quiet operation normally inherent in a closed Rankine cycle turbine engine.

While certain embodiments of the invention have been illustrated and described, it is not intended to limit the invention to such embodiments, and it is contemplated that changes and modifications may be made and incorporated as desired or required, within the scope of the following claims.

We claim:

1. Rotary closed Rankine cycle engine powered electric generating apparatus comprising:

a housing mounted for rotation about an axis and including an internal annular coaxial power fluid boiler operable for generating pressure power fluid vapor, a power fluid expander in said housing including a coaxial driving member and shaft rotatably driven at a first predetermined speed by the power fluid generated in the boiler, condenser means rotatable with the housing for condensing the exhaust power fluid vapor from the expander, an alternator mounted coaxially in the housing having the stator thereof rotatable with said housing and the armature thereof on said shaft, gas bearings rotatably supporting the power fluid driving member and shaft, means for conducting a portion of the power fluid condensate from the condenser means in heat exchange relation with the alternator to cool the same and be vaporized by heat exchange therewith to provide low pressure power fluid vapor for lubricating the gas bearings, means for conducting the low pressure vapor to said gas bearings, means for returning the other portion of the power fluid condensate from the condenser means directly to the boiler, drive means to rotationally drive said housing and condenser means at a second predetermined speed slower than said first speed operable to maintain the liquid power fluid in the boiler uniformly distributed circumferentially therein with a liquid/vapor interface disposed at a predetermined radius from the rotation axis of the boiler, and means for conducting the electric current generated by the alternator to a load located exteriorly of the apparatus.

2. Apparatus as claimed in claim 1 wherein the means for conducting a portion of the power fluid condensate in heat exchange relation with the alternator is constructed and operable to establish and maintain said condensate between a first liquid level adjacent the condenser means and a second liquid level in said alternator, the second liquid level being at a greater radius from the rotation axis than the first liquid level, whereby low pressure power fluid vapor is supplied to the gas bearings at a constant pressure equal to the sum of the pressure in the condenser means and the pressure differential between the first and second liquid levels developed by the centrifugal force generated at said liquid levels by rotation of the housing-condenser means.

3. Apparatus as claimed in claim 1 wherein the condenser means comprises a primary condenser and a secondary condenser.

4. Apparatus as claimed in claim 3 wherein the portion of the power fluid condensate conducted in heat exchange relation with the alternator is condensed in the secondary condenser.

5. Apparatus as claimed in claim 4 wherein the primary and secondary condensers are mounted coaxially at respectively opposite sides of the housing and rotate therewith as a unit.

6. Apparatus as claimed in claim 2 wherein the condenser means comprises a primary condenser and a secondary condenser.

7. Apparatus as claimed in claim 6 wherein the portion of the power fluid condensate conducted in heat exchange relation with the alternator is condensed in the secondary condenser.

8. Apparatus as claimed in claim 7 wherein the primary and secondary condensers are mounted coaxially at respectively opposite sides of the housing and rotate therewith as a unit.

9. Apparatus as claimed in claim 1 wherein the drive means to rotationally drive the housing and condenser means comprises a magnetic-harmonic drive from the expander shaft to the housing.

10. Apparatus as claimed in claim 9 wherein the magnetic-harmonic drive means for the housing comprises a two-pole permanent magnet rotor on the expander shaft cooperable with an annular circumscribing series of magnetic elements rotatable with the housing and a stationary ring member of magnetic material circumscribing said series of magnetic elements, said ring member having on the inner circumference thereof an annular series of pole tips disposed in cooperative relation to said magnetic elements and the number of said magnetic elements being less than the number of said pole tips.

11. Apparatus as claimed in claim 1 wherein the condenser means comprises a single condenser.

12. Apparatus as claimed in claim 11 wherein the single condenser is mounted coaxially at one side of the housing and rotates therewith as a unit.

13. Apparatus as claimed in claim 2 wherein the condenser means comprises a single condenser.

14. Apparatus as claimed in claim 13 wherein the single condenser is mounted coaxially at one side of the housing and rotates therewith as a unit.

15. Apparatus as claimed in claim 2 wherein the drive means to rotationally drive the housing and condenser means comprises a magnetic-harmonic drive from the expander shaft to the housing.

16. Apparatus as claimed in claim 15 wherein the magnetic-harmonic drive means for the housing comprises a two-pole permanent magnet rotor on the expander shaft cooperable with an annular circumscribing series of magnetic elements rotatable with the housing and a stationary ring member of magnetic material circumscribing said series of magnetic elements, said ring member having on the inner circumference thereof an annular series of pole tips disposed in cooperative relation to said magnetic elements and the number of said magnetic elements being less than the number of said pole tips.

17. Apparatus as claimed in claim 15 wherein the condenser means comprises a primary condenser and a secondary condenser.

18. Apparatus as claimed in claim 17 wherein the portion of the power fluid condensate conducted in heat exchange relation with the alternator is condensed in the secondary condenser.

19. Apparatus as claimed in claim 18 wherein the primary and secondary condensers are mounted coaxially at respectively opposite sides of the housing and rotate therewith as a unit.

20. Apparatus as claimed in claim 15 wherein the condenser means comprises a single condenser.

21. Apparatus as claimed in claim 20 wherein the single condenser is mounted coaxially at one side of the housing and rotates therewith as a unit.

22. Apparatus as claimed in claim 8 wherein the drive means to rotationally drive the housing and condenser means comprises a magnetic-harmonic drive from the expander shaft to the housing.

23. Apparatus as claimed in claim 22 wherein the magnetic-harmonic drive means for the housing comprises a two-pole permanent magnet rotor on the expander shaft cooperable with an annular circumscribing series of magnetic elements rotatable with the housing and a stationary ring member of magnetic material circumscribing said series of magnetic elements, said ring member having on the inner circumference thereof an annular series of pole tips disposed in cooperative relation to said magnetic elements and the number of said magnetic elements being less than the number of said pole tips.

24. Apparatus as claimed in claim 21 wherein the magnetic-harmonic drive means for the housing comprises a two-pole permanent magnet rotor on the expander shaft cooperable with an annular circumscribing series of magnetic elements rotatable with the housing and a stationary ring member of magnetic material circumscribing said series of magnetic elements, said ring member having on the inner circumference thereof an annular series of pole tips disposed in cooperative relation to said magnetic elements and the number of said magnetic elements being less than the number of said pole tips.

25. Apparatus as claimed in claim 1 wherein the condenser means comprises coaxially disposed axially spaced annular fins having heat exchange tubes extending longitudinally therethrough and the speed at which the condenser means is ratatably driven is operable to cause a gaseous heat exchange fluid to be conveyed and accelerated by viscosity shear forces outwardly between the fins of said condenser means to the velocity providing optimum heat exchange between said gaseous fluid and the fluid in the heat exchange tubes of said condenser means.

26. Apparatus as claimed in claim 4 wherein the primary and secondary condensers each comprise coaxially disposed axially spaced annular fins having heat exchange tubes extending longitudinally therethrough and the speed at which the condensers are rotatably driven is operable to cause a gaseous heat exchange fluid to be conveyed and accelerated by viscosity shear forces outwardly between the fins of said condensers to the velocity providing optimum heat exchange between said gaseous fluid and the fluid in the heat exchange tubes of said condensers.

27. Apparatus as claimed in claim 2 wherein the condenser means comprises coaxially disposed axially spaced annular fins having heat exchange tubes extending longitudinally therethrough and the speed at which the condenser means is rotatably driven is operable to cause a gaseous heat exchange fluid to be conveyed and accelerated by viscosity shear forces outwardly between the fins of said condenser means to the velocity providing optimum heat exchange between said gaseous fluid and the fluid in the heat exchange tubes of said condenser means.

28. Apparatus as claimed in claim 8 wherein the primary and secondary condensers each comprise coaxially disposed axially spaced annular fins having heat exchange tubes extending longitudinally therethrough and the speed at which the condensers are rotatably driven is operable to cause a gaseous heat exchange fluid to be conveyed and accelerated by viscosity shear forces outwardly between the fins of said condensers to the velocity providing optimum heat exchange between said gaseous fluid and the fluid in the heat exchange tubes of said condensers.

* * * * *